United States Patent [19]

Rowcliffe et al.

[11] 4,172,742

[45] Oct. 30, 1979

[54] ALLOYS FOR A LIQUID METAL FAST BREEDER REACTOR

[75] Inventors: Arthur F. Rowcliffe, Oak Ridge, Tenn.; Melvin L. Bleiberg, Mt. Lebanon, Pa.; Sidney Diamond, Monroeville, Pa.; Ram Bajaj, Youngwood, Pa.

[73] Assignee: The United States of America as represented by the United States Department of Energy, Washington, D.C.

[21] Appl. No.: 867,656

[22] Filed: Jan. 6, 1978

[51] Int. Cl.[2] ..... C22C 38/06; C22C 38/50

[52] U.S. Cl. ..... 148/38; 75/124; 75/128 F; 75/128 T; 75/128 W

[58] Field of Search ..... 75/122, 124, 128 T, 75/128 W, 128 Z, 128 V, 128 F; 148/38

[56] References Cited

U.S. PATENT DOCUMENTS

| | | | |
|---|---|---|---|
| 3,065,067 | 11/1962 | Aggen | 75/128 F |
| 3,300,347 | 1/1967 | Kasza et al. | 75/128 F |
| 3,420,660 | 1/1969 | Kawahata et al. | 75/122 |
| 3,895,939 | 7/1975 | Brooks et al. | 75/124 |
| 4,066,447 | 1/1978 | Smith, Jr. et al. | 75/122 |

FOREIGN PATENT DOCUMENTS

| | | | |
|---|---|---|---|
| 999439 | 7/1965 | United Kingdom | 75/128 F |

*Primary Examiner*—Arthur J. Steiner
*Attorney, Agent, or Firm*—R. T. Randig

[57] ABSTRACT

An essentially gamma-prime precipitation-hardened iron-chromium-nickel alloy has been designed with emphasis on minimum nickel and chromium contents to reduce the swelling tendencies of these alloys when used in liquid metal fast breeder reactors. The precipitation-hardening components have been designed for phase stability and such residual elements as silicon and boron, also have been selected to minimize swelling. Using the properties of these alloys in one design would result in an increased breeding ratio over 20% cold worked stainless steel, a reference material, of 1.239 to 1.310 and a reduced doubling time from 15.8 to 11.4 years.

The gross stoichiometry of the alloying composition comprises from about 0.04% to about 0.06% carbon, from about 0.05% to about 1.0% silicon, up to about 0.1% zirconium, up to about 0.5% vanadium, from about 24% to about 31% nickel, from 8% to about 11% chromium, from about 1.7% to about 3.5% titanium, from about 1.0% to about 1.8% aluminum, from about 0.9% to about 3.7% molybdenum, from about 0.04% to about 0.8% boron, and the balance iron with incidental impurities.

4 Claims, 24 Drawing Figures

ALLOYS FOR A LIQUID METAL FAST BREEDER REACTOR

BACKGROUND OF THE INVENTION

1. Field of the Invention

The present invention is directed to an austenitic iron-base alloy containing nickel and chromium which has been solution-strengthened as well as precipitation-hardened and finds use both for fuel cladding and as a duct material in liquid metal fast breeder reactors. Since the alloys of the present invention are utilized as fuel cladding as well as a duct material it will be apparent that mechanical properties at elevated temperatures are of great importance. In addition, since the alloys will be under the constant influence of irradiation during operation as a fuel cladding material within a liquid metal fast breeder reactor, it becomes apparent that heavy emphasis must be placed on the low swelling characteristics of the alloy or at least having known swelling tendencies within given constraints.

In order to achieve these ends it has been found advantageous to control the chemistry of the alloying components such that upon the requisite precipitation-hardening, the matrix composition of the remaining alloy will be balanced in such a way as to provide for the low swelling tendencies without compromising the mechanical strength which attributes are necessary within the contemplated field of use of the subject composition.

2. Description of the Prior Art

For over 20 years the commercial composition known as A-286 has been utilized extensively for operation at elevated temperatures. A-286 is a wrought alloy containing nominally about 0.08% carbon, about 1.25% manganese, about 1.0% silicon, about 14.75% chromium, about 26% nickel, about 1.25% molybdenum, about 2.10% titanium, about 0.35% aluminum, about 0.25% vanadium, about 0.005% boron, and the balance iron with incidental impurities. This composition of matter in general terms has been described in such patents as U.S. Pat. Nos. 2,519,406 to Scott et al, 2,641,540 to Mohling et al, 3,199,978 to Brown et al, and 3,212,884 to Soler et al. An examination of all of these patents makes it clear beyond equivocation that the primary concern with the inventors is to obtain the requisite strength at elevated temperatures commensurate with sufficient ductility that the steels or austenitic alloy compositions would be useful for example in gas turbine parts which are subject to dynamic stresses. In none of these patents was any consideration given to controlling the swelling tendency of these alloys especially where the same are subject to the influence of irradiation over extended periods of time at elevated temperatures.

While commercial A-286 has the requisite strength for the intended temperature range of operation to which the present composition of matter is directed, nonetheless there is no suggestion as to how to control the swelling tendencies of such alloys. Consequently the candidate material which has been originally selected for fuel cladding and for duct work applications in the liquid metal fast breeder reactor has been a 20% cold worked stainless steel of the AISI Type 316 composition. Upon investigation of the swelling tendency of AISI Type 316 especially as predicted by nickel ion bombardment using a Van de Graaf apparatus, it becomes clear that the Type 316 candidate material has an extreme swelling problem in comparison with commercial A-286.

With these considerations in mind, it has been postulated that account must be taken of the solid solution strengthening components and the precipitation-hardening components together their effect upon the matrix chemistry since it is believed that the swelling is due in major part to the control of the matrix chemistry after having due regard to the various precipitation reactions which take place. In this respect, there must be a nickel and chromium trade off in the base chemistry and it would appear that the silicon and boron contents also function to aid in controlling swelling, yet these latter two elements are a primary requisite for the attainment of a portion of the mechanical property prerequisite such as ductility at elevated temperatures. Within this realm the substitution solutes such as molybdenum, titanium and aluminum, must be considered both for their influence on the swelling characteristics as well as their function on the mechanical properties.

It has been found that the gamma-prime precipitate, which is the fundamental hardening and strengthening mechanism of the subject composition, appears to be insensitive to the degree of swelling which the alloy undergoes. Thus, it is with this thought in mind that it is necessary to minimize the amount of nickel and chromium which can be utilized for the proper control of swelling in these alloys. Consequently, emphasis can be placed upon the size of the gamma-prime and its distribution within the grains so as to obtain enhanced mechanical properites without detrimentally affecting the swelling tendency of the overall chemical composition.

SUMMARY OF THE INVENTION

The present invention is concerned with the gamma-prime precipitation hardened iron-base alloy containing chromium, nickel which composition of matter is useful for elevated temperature operations in a liquid metal fast breeder reactor. Essentially, the composition of matter comprises up to about 0.06% carbon, up to about 1% silicon, up to about 0.01% zirconium, up to about 0.5% vanadium, from about 24 to about 31% nickel, from about 8% to about 11% chromium, from about 1.7 to about 3.5% titanium, from about 1% to about 1.8% aluminum, from about 0.9% to about 3.7% molybdenum, from about 0.04% to about 0.08% boron, and the balance iron with incidental impurities.

Within the foregoing limitations in terms of weight percent of the gross stoichiometry of the alloying composition, the matrix of the alloy, after a solution heat treatment at 1050° C. for about one-half hour following by quenching and thereafter aging for a period of 10 hours at 815° C. or 24 hours at 700° C. will not have an equilibrium amount of the gamma-prime precipitate occurring within the alloy. Nonetheless, sufficient precipitation will have occurred so that the matrix composition falls within the range between about 23% and about 29% nickel, about 7% and about 11.5% chromium, about 1.3% and about 2.6% titanium, about 1.2% and about 1.5% aluminum, about 0.9% and about 3.3% molybdenum and the balance essentially iron with other incidental impurities. The alloy of this invention as hereinbefore described and in the heat treated condition will have less than about 5% by weight of gamma-prime and other precipitated compositions. The gain boundaries will be free of continuous precipitation of secondary phases and the gamma-prime will be fairly uniformly distributed throughout the grains. The alloy will swell about 1/10 as much at peak swelling temperatures as commercial A-286 and will exhibit mechanical properties at a temperature between about 1000° and 1200° F. at least equal to that of commercial A-286.

DESCRIPTION OF THE PREFERRED EMBODIMENT

Figure 1:
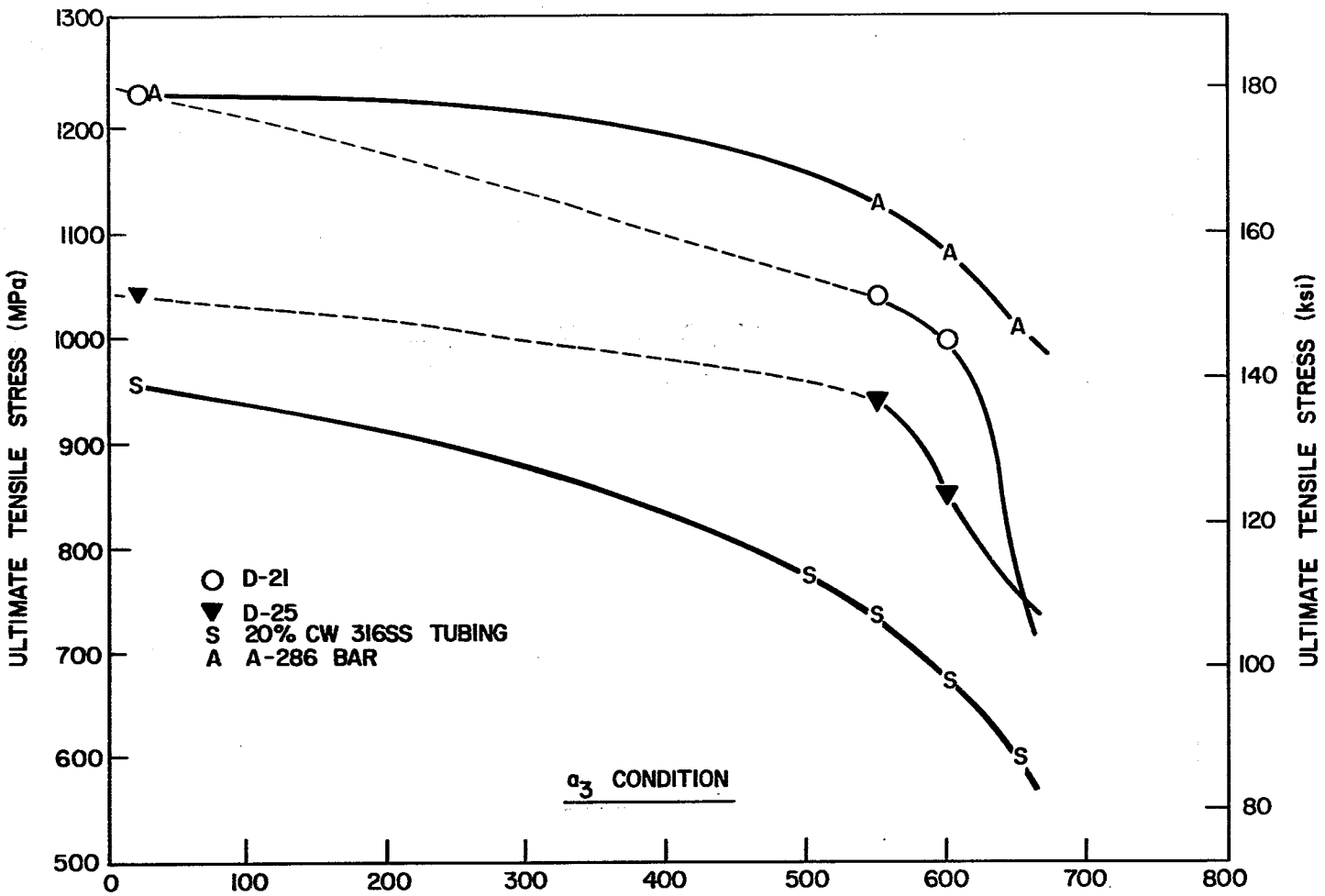
FIG. 1 is a plot of the Ultimate Tensile Strength of the alloys of the present invention as well as prior art composition.

The alloy of the present invention contemplates a composition set forth more fully hereinafter in Table 1.

TABLE I

| | CHEMICAL COMPOSITION (Wt. %) | | | |
|---|---|---|---|---|
| Element | General Range | Preferred Range A | Preferred Range B | Matrix |
| C | up to $0.06_x$ | .04–.06 | .04–.06 | |

TABLE I-continued

| | CHEMICAL COMPOSITION (Wt. %) | | | |
|---|---|---|---|---|
| Element | General Range | Preferred Range A | Preferred Range B | Matrix |
| Mn | up to 2.0 | up to 1.0 | up to 1.0 | |
| Si | up to 1.0 | .05–1.0 | .05–1.0 | |
| Zr | up to 0.1 | .005–.05 | up to 0.1 | |
| Va | up to 0.5 | .05 | | |
| Ni | 24–31 | 24.5–25.5 | 29.5–30.5 | 23–29 |
| Cr | 8–11. | 8.25–8.75 | 10.25–10.75 | 7–11.5 |
| Ti | 1.7–3.5 | 3.0–3.5 | 1.7–2.1 | 1.3–2.6 |
| Al | 1.0–1.8 | 1.5–1.8 | 1.5–1.8 | 1.2–1.5 |
| Mo | 0.9–3.7 | 0.9–1.25 | 3.5–3.7 | 0.9–3.3 |
| B | 0.004–0.008 | 0.0045–0.0055 | 0.006–0.007 | |
| Fe | Balance | Balance | Balance | Balance |

By inspection of Table I it can be seen that there are two preferred ranges as well as a matrix composition and the matrix composition may not necessarily fall within the confines of the general range as set forth hereinbefore. This results from the fact that the matrix composition is that composition after removing all of the carbides and other secondary phases as well as the principal hardening component, namely the gamma-prime, which may be identified as $Ni_3(Al,Ti)$. This hardening mechanism is well known in the iron base nickel-chromium alloy system and it is based upon this hardening mechanism that the matrix composition has been determined for the controlled swelling characteristics which are essential for an alloy for use in the liquid metal fast breeder reactor.

The function of the alloying elements of the composition of the alloy of the present invention are essentially well known. However, it should be pointed out that the alloy of the present composition was designed by minimizing the nickel and chromium contents without unduly sacrificing the mechanical properties which are derived through the solid solution strengthening elements such as molybdenum, the ductilizing element boron and the major hardening mechanism gamma-prime.

Reference may be had to Table II which lists the chemical composition of a number of alloys that were made and tested in order to substantiate certain of the aspects of mechanical properties at elevated temperatures as well as low swelling under the influence of irradiation.

TABLE II

| | CHEMICAL COMPOSITION (Wt. %) | | | | |
|---|---|---|---|---|---|
| Element | D-21 | D-21A | D-21B | D-25 | D-25A |
| C | 0.05 | 0.044 | 0.052 | 0.05 | 0.052 |
| Mn | 1.0 | 0.97 | 1.04 | 1.0 | 0.97 |
| Si | 1.0 | 0.10 | 0.10 | 1.0 | 0.20 |
| Zr | — | — | — | 0.006 | 0.005 |
| Va | — | — | 0.54 | — | — |
| Ni | 25 | 24.6 | 24.5 | 30 | 30.2 |
| Cr | 8.3 | 8.32 | 8.45 | 10.5 | 10.5 |
| Ti | 3.3 | 3.43 | 3.29 | 1.7 | 1.84 |
| Al | 1.7 | 1.56 | 1.59 | 1.25 | 1.32 |
| Mo | 1.0 | 0.98 | 1.00 | 3.5 | 3.38 |
| B | 0.005 | | | 0.006 | |
| Fe | Bal. | Bal. | Bal. | Bal. | Bal. |

The alloys as set forth in Table II were melted, following which the same were hot worked, extruded and thereafter cold reduced to the finished size bars.

The finish size bars were solution annealed at a temperature within the range between about 1000° C. and about 1100° C. for time periods of up to about 1 hour. The typical solution anneal consisted of heating the alloy to 1050° C. for a time period of ½ hour. Thereafter the solution annealed alloys were subjected to two different aging treatments referred to as the $A_1$ and $A_3$ treatment. $A_1$ consisted of aging at 815° C. for 10 hours and $A_3$ used 700° C. for a time period of 24 hours. It will be appreciated that these alloys can be urged at a temperature between about 650° C. and about 850° C. for time periods of up to 24 hours, the longer times being preferred for the lower temperatures and vice versa.

The swelling resistance was evaluated employing a Van de Graaf apparatus employing nickel$^{+2}$ ion bombardment at two levels namely 140 displacements per atom (equivalent to $1.8\times10^{23}$ NVT) and 200 displacements per atom (equivalent $2.6\times10^{23}$ NVT). As thus irradiated, the swelling resistance was evaluated and some of these results are graphically illustrated in FIG. 4.

The phase characterization of these alloys is set forth in the tables and in the photomicrographs identified hereinbefore.

More specifically heat treated compositions of alloys D-21 and D25 were tested at various temperatures in order to assess the tensile properties exhibited by these materials. Certain of the compositions were also tested after having been subjected to various amounts of irradiaton and both mechanical properties and the degree of swelling were assessed in these evaluations. Reference is now directed to FIG. 1 which illustrates the effect of temperature on the ultimate tensile strength of the alloys of the present invention prior to nickel ion bombardment. For comparison purposes, there has also been plotted the ultimate tensile strength of a 20% cold worked type 316 stainless steel tubing as well as commercially available A-286 bar. The data set forth in FIG. 1 consists of materials which have not been subjected to irradiation. It can be seen by inspection from FIG. 1 that alloys D-21 and D-25 which fall within the scope of the present invention closely approximate the ultimate tensile strength exhibited by the commercially available A-286 alloy and far exceeds that of the 20% cold worked type 316 stainless steel. It will become apparent that alloys D-21 and D-25 clearly fulfill the requirements for the fuel cladding and ducting material in the liquid metal fast breeder reactor.

Figure 2:
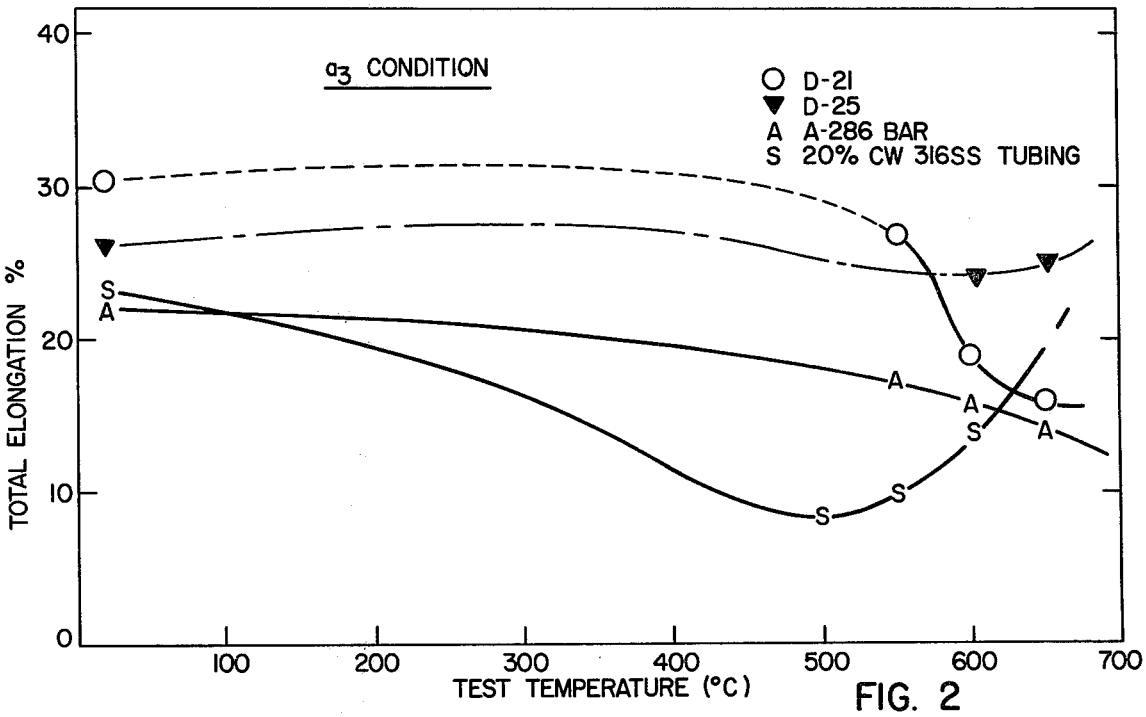
FIG. 2 is a plot of the Yield Strength of the alloys similar to FIG. 1.

Substantially the same results are obtained when comparing the yield strength of the same alloys as is set forth in attached FIG. 2 hereof. It can be seen that both alloys D-21 and D-25 show substantially better yield strength in the heat treated and unirradiated condition than that of both commercial A286 as well as cold worked type 316 stainless steel.

Figure 3:
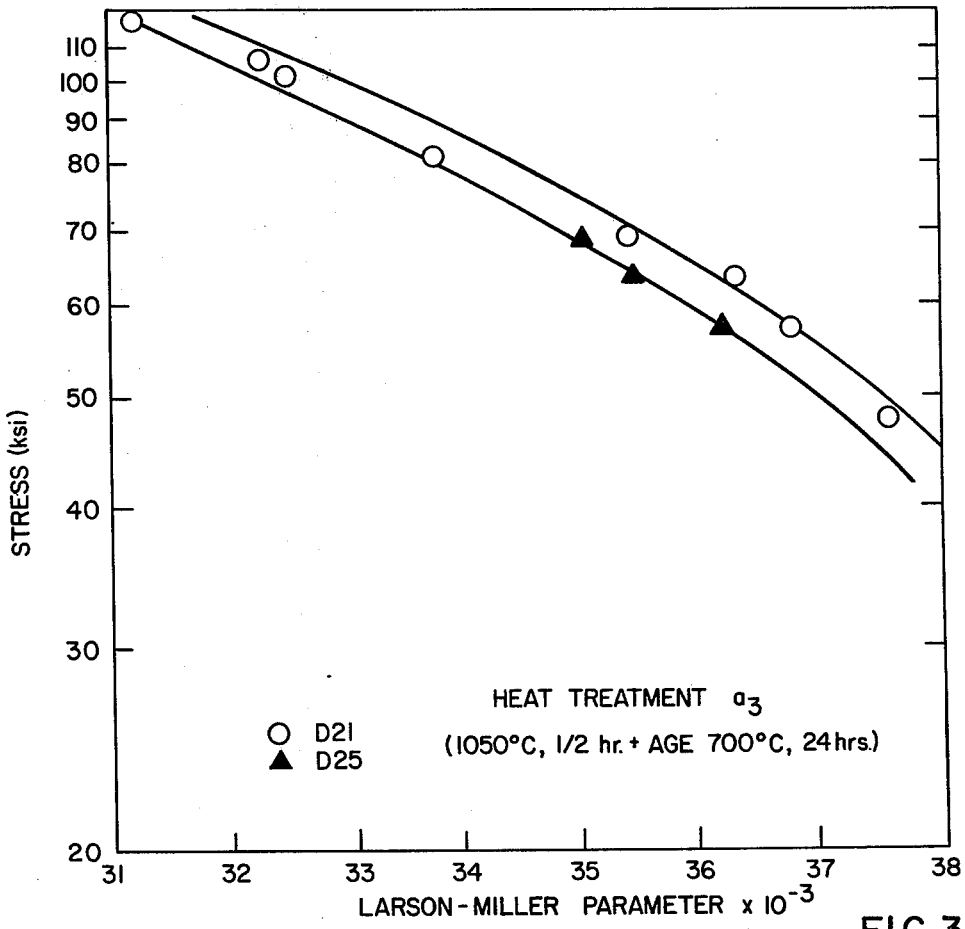
FIG. 3 is a plot of the Larson Miller Parameter of the alloys of the present invention.

Alloys D-21 and D-25 were also tested in the stress rupture test at various stresses, employing various loads. The Larson-Miller Parameter was used to evaluate these test results. As illustrated graphically in FIG. 3 these alloys fell within a narrow band. The commercial alloy A-286 also falls within this narrow band but the candidate material 20% cold worked Type 316 stainless steel had far inferior stress rupture properties. Since the stress rupture test is an important criteria for evaluating the performance of materials at elevated temperatures these results confirm the suitability of these alloys as fuel cladding material for use in liquid metal fast breeder reactors.

In order to assess the swelling behavior alloys D-21 and D-25 were employed as well as candidate material 20% cold worked type 316 stainless steel, the commercial A-B 286 composition. The data were obtained from the test conducted on a 6 megavolt Van de Graaf machine using 4-MEV nickel +2 ions.

Such irradiation testing has been recognized as effectively compressing the time component by a factor of about $10^3$ hours. This then gives an excellent prediction of the behavior of these alloys under prolonged exposure to neutron irradiation while employed in a liquid metal fast breeder reactor.

After nickel-ion irradiation as is set forth hereinbefore, it was found that both alloys D-21 and D-25 exhibit superior swelling resistance as predicted from experimental and theoretical data on which its composition is derived. Both alloys D-21 and D-25 swell about 1/10 as much at the peak swelling temperature as commercial A-286 alloy. Cold worked Type 316 stainless steel is far inferior. The mechanical properties of D-21 and D-25 are comparable to A-286 and after prolonged exposure at elevated temperatures and even under the influence of the nickel-ion bombardment alloys D-21 and D25 show no evidence of precipitating undesirable Sigma phase. The swelling of D-21 and D-25 of about 5 to 7% at 250 displacements per atom which is equivalent to about $3.5\times10^{23}$ NVT in which E is greater than 0.1 MeV is close to the design requirements in that it nearly matches the fuel swelling for the proposed mixed oxides fuels for the liquid metal fast breeder reactor.

Figure 4:
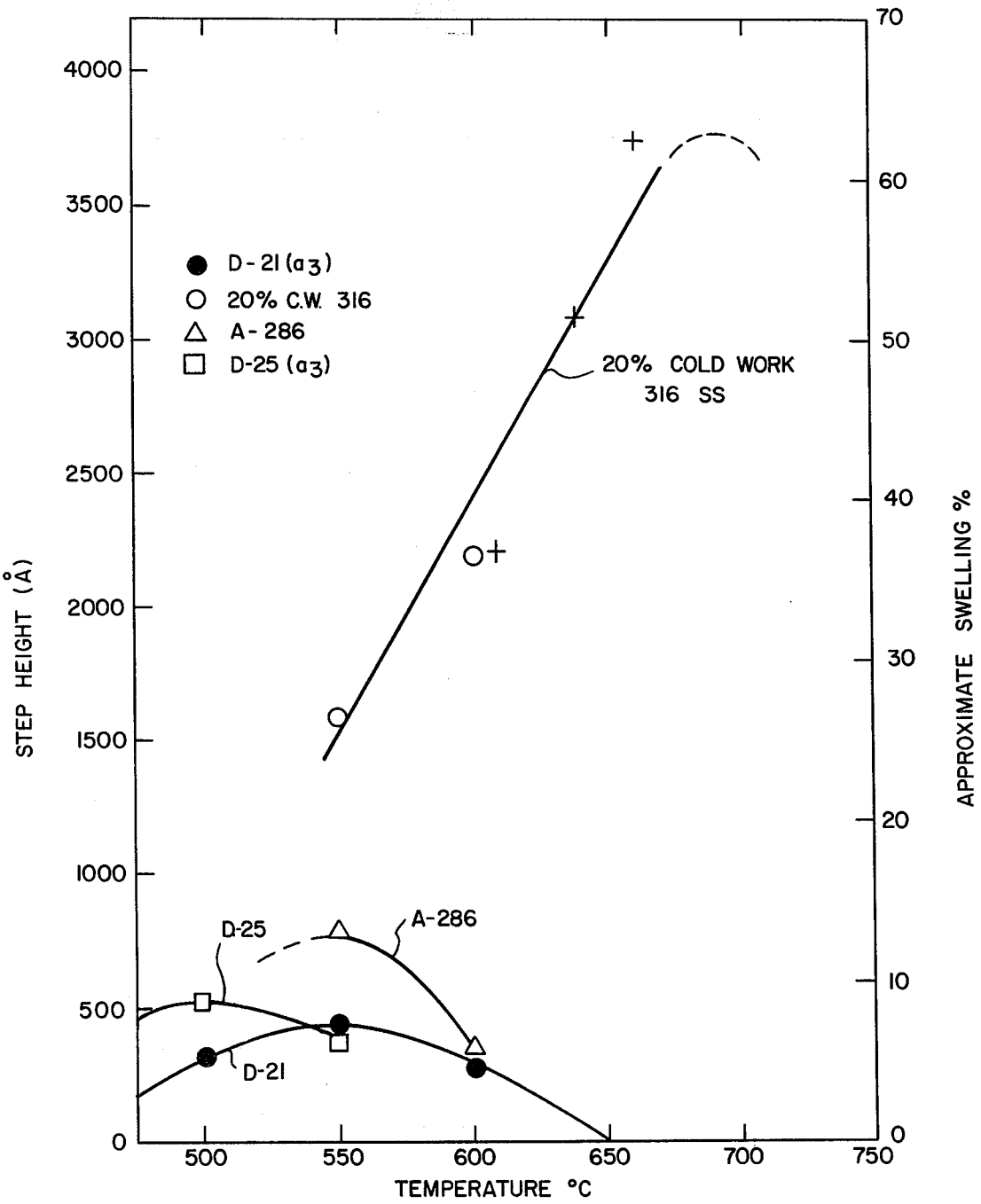
FIG. 4 is a plot of the swelling characteristics versus temperature of the alloys of the present invention as well as prior art alloys.
Figure 5A:
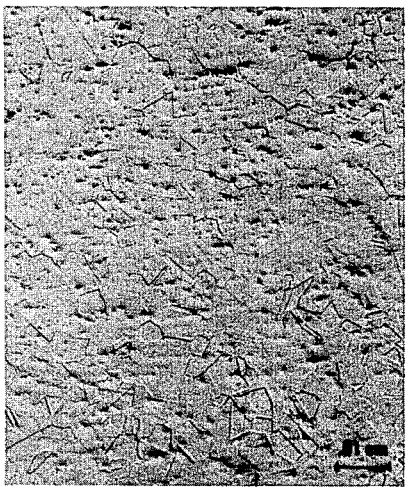
FIGS. 5A–C are optical photomicrographs of the grain structure of Alloy D-21A at different magnifications.
Figure 5B:
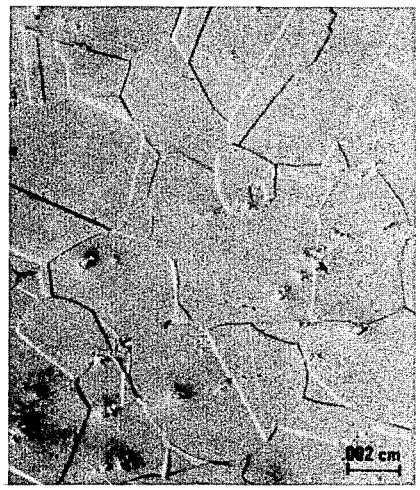
Figure 5C:
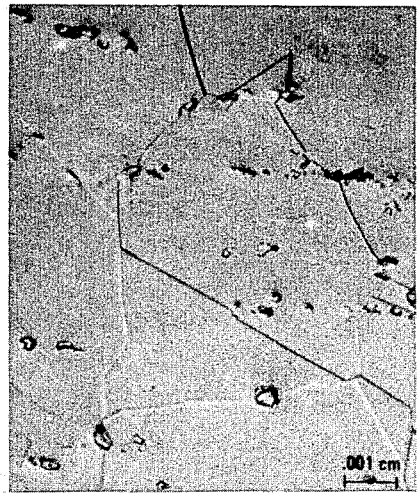
Figure 6A:
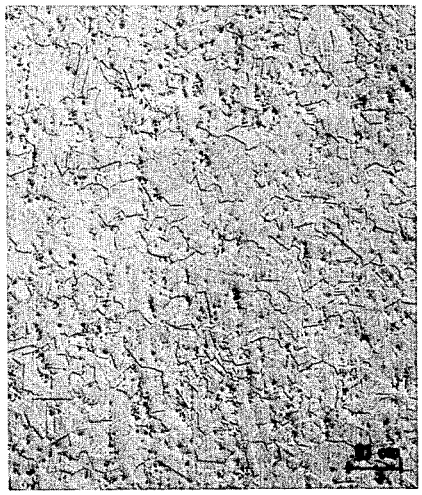
FIGS. 6A–C are optical photomicrographs of the grain structure of Alloy D-21B at different magnifications.
Figure 6B:
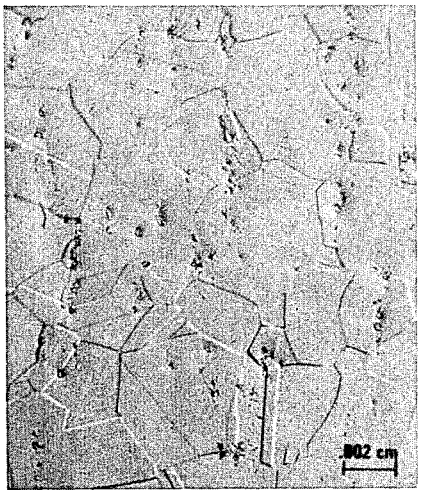
Figure 6C:
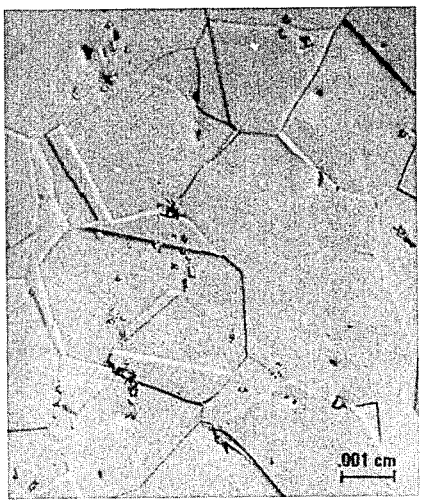
Figure 7A:
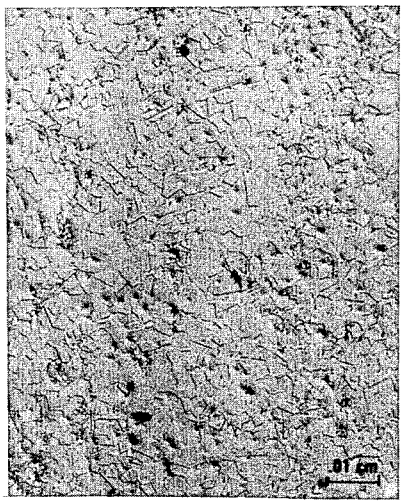
FIGS. 7A and 7B are optical photomicrographs of the grain structure of alloy D-25A at different magnifications.
Figure 7B:
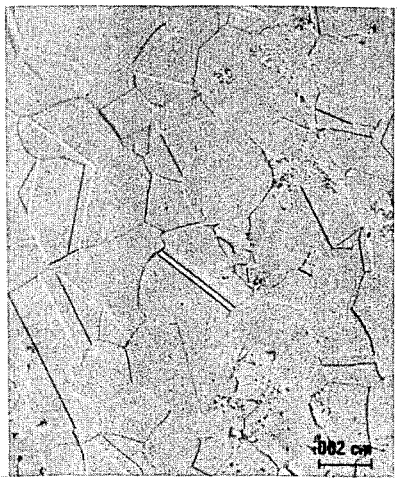

Reference to FIG. 4 which shows the temperature dependence of swelling at 250 displacements per atom produced by 4 MeV nickel plus 2 ions is graphically illustrated. From inspection of FIG. 4 it becomes clear beyond equivocation that the alloy of the present invention has very low swelling tendencies even at the peak swelling temperature in comparison with similar type compositions, namely, commercial A-286 as well as the candidate material composition 20% cold worked Type 316 stainless steel.

The alloys of the present invention have also been assessed from the standpoint of the thermal phase stability and this becomes quite critical in the mechanical property aspect of the alloy as well as in the determination of the matrix composition which governs the swelling characteristics of the alloy. In this respect, both alloys D-21 and D-25 were evaluated for the thermal phase stability and in addition, modifications of alloys D-21, namely, D-21A and D-21B which are low silicon variations of the D-21 composition, the D-21B composition also containing discrete amounts of vanadium as is set forth in Table II, and the D-25 composition which also contains low amounts of silicon were made and tested for the thermal stability of the hardening phases as well as the other phases which were present in the alloy of the present invention. The microstructure analysis that was performed on these compositions was to determine the phase identification of the original alloys D-21 and D-25 as well as the modifications thereof and such compositions were evaluated in terms of employing standard light metallography, transmission microscopy and extractive chemical analysis. As will appear more fully hereinafter, it has been found that the volume fraction of the gamma-prime was not dependent upon a reduction in the silicon content in the modified version of D-21 and D-25.

Moreover the total weight percent of carbides and Laves phases in alloys D21 and D-25 did not exceed 1 weight percent. This augers well from the standpoint of the grain boundaries being substantially free from continuous networks of precipitates therein. In addition to that it has also been found that in these alloys the Laves phases did not exceed 0.5 weight percent, thus the total percentage of carbides and laves phases after solution heat treatment and aging at 815° was below about 0.5%. Transmission microscopy shows precipitation free grain boundaries after aging at the lowered temperatures in all alloys and after aging at the higher temperatures the grain boundary precipitates in the low silicon alloys was limited to fairly disbursed, discrete particles thereby resulting in improved ductility in these alloys. Reference may be had to Table II which indicates the carbide extraction data for alloys D-21 and D-25.

TABLE III

CARBIDE EXTRACTION DATA

| Alloy | Heat Treatment* | Wt. % Residue | Major | Minor |
|---|---|---|---|---|
| D-21 | $a_1$ | 1.15 | MC 35% Laves 60% ($Fe_2$ Mo) | $M_3B$ 5% |
| D-21 | $a_3$ | 0.56 | MC 95% | Laves 5% |
| D-25 | $a_1$ | 1.02 | MC 40% Laves 60% | $M_3B$ 5% |
| D-25 | $a_3$ | 0.48 | MC 90% | Laves 5% $M_3B_2$ 5% $Fe_2Mo$ (trace) |

*$a_1$ - S.A. 1050° C., ½ hr., age 10 hrs. at 815° C.
$a_3$ - S.A. 1050° C., ½ hr., age 24 hrs. at 700° C.

The data set forth in Table II indicates a lower percentage of the carbides and secondary phases, that is, those phases other than gamma-prime which are present, and the lower percentages occur in alloy D-25 as compared to alloy D-21. It should be noted, however, that the total weight percent of these secondary phases was about 1% with the Laves phases comprising about half of that amount.

Reference to Table IV will include the gamma-prime extraction data. Since this residue contained all phases leaving the matrix in an acid solution, the net weight percent of gamma-prime was calculated by subtracting the carbide extraction data, namely, Table III from the gamma-prime extraction results. The resultant chemistry of the matrix was thereafter evaluated by atomic absorption analysis of the acid solutions.

To substantially the same effect, the modified alloys, namely, D-21A, D-21B and D-25A were treated in the same manner to obtain the carbide extraction data for these compositions, and these data are set forth in attached Table V. The gamma-prime extraction data with the net matrix chemistry of the modified alloys is set forth in Table VI.

TABLE V

CARBIDE EXTRACTION DATA

| Alloy | Heat Treatment* | Wt. % Residue | Phases XRD Major | Phases XRD Minor |
|---|---|---|---|---|
| D-21A | $a_1$ | 0.34 | MC 40% Laves 60% | $M_3B$, 5% |
| D-21A | $a_3$ | 0.14 | MC 90% | Laves 5% $M_3B$, 5% |
| D-21B | $a_1$ | 0.47 | MC 45% Laves 55% | |
| D-21B | $a_3$ | 0.43 | MC 90% | Laves 10% |
| D-25A | $a_1$ | 0.45 | MC 40% Laves 60% | |
| D-25A | $a_3$ | 0.36 | MC 40% | Laves 5% $M_3B$, 5% |

*$a_1$ - S.A. 1050° C., ½ hr., then age 10 hrs. 815° C.
$a_3$ - S.A. 1050° C., ½ hr., then age 24 hrs. 700° C.

TABLE VI

γ' EXTRACTION DATA

| Alloy | Heat Treatment | γ' + Carbide Residue, Wt. % | Net γ' Wt. %* | Net-Matrix Chemistry (all phases extracted) in Wt. % Ni | Cr | Ti | Al | Mo | Si | Mn | V | Fe |
|---|---|---|---|---|---|---|---|---|---|---|---|---|
| D-21A | $a_1$ | 4.05 | 3.71 | 23.1 | 8.60 | 2.34 | 1.43 | 0.94 | 0.12 | 0.98 | — | 61.2 |
| D-21A | $a_3$ | 2.02 | 1.78 | 24.1 | 8.33 | 2.64 | 1.51 | 1.04 | 0.17 | 1.02 | — | 61.1 |
| D-21B | $a_1$ | 3.81 | 3.04 | 23.3 | 8.43 | 2.34 | 1.42 | 1.05 | 0.16 | 1.05 | 0.5 | 61.3 |
| D-21B | $a_3$ | 2.29 | 1.86 | 24.2 | 8.38 | 2.56 | 1.47 | 1.00 | 0.12 | 1.02 | 0.5 | 60.4 |
| D-25A | $a_1$ | 3.51 | 3.06 | 28.9 | 10.66 | 1.31 | 1.24 | 3.34 | 0.10 | 1.01 | — | 52.4 |
| D-25A | $a_3$ | 2.35 | 2.00 | 28.8 | 11.10 | 1.46 | 1.28 | 3.27 | 0.11 | 1.01 | — | 52.9 |

*Total residue less carbides, Table V

In general, the grain morphologies of the modified alloys, namely D-21A, D-21B and D-25A, show a uniform grain size for all of the alloys with typical grain diameters of 50 microns after heat treatment at the 815° temperature aging treatment. The particles within the grains are MC carbides and no adverse precipitation was visible in the grain boundaries of any of the modified alloys. This is more clearly shown in the attached photomicrographs of FIGS. 5A, 5B, 5C, 6A, 6B, 6C, 7A and 7B inclusive.

From the data set forth hereinbefore, as would be expected the volume fraction of the residue was higher for the higher aging temperature, namely, the temperature of 815° C. It is significant to note that in all cases the total fraction of the residue does not exceed about 0.5 wt. %. Also the residues contain low fractions of Laves and boride phases. With respect to the gamma-prime extraction data as set forth in Table IV, for the modified alloys, the gamma-prime content is about 2 weight percent after the low temperature treatment and

TABLE IV

γ' EXTRACTION DATA

| Alloy | Heat Treatment | γ' + Carbide Residue, Wt. % | Net γ' Wt. %* | Net-Matrix Chemistry (all phases extracted) In Wt. % Ni | Cr | Ti | Al | Mo | Si | Mn | Fe |
|---|---|---|---|---|---|---|---|---|---|---|---|
| D-21 | $a_1$ | 4.78 | 3.63 | 23.4 | 0.57 | 2.34 | 1.42 | 0.92 | 1.08 | 0.96 | 60.7 |
| D-21 | $a_3$ | 1.94 | 1.38 | 24.9 | 7.50 | 2.60 | 1.51 | 1.05 | 0.97 | 1.04 | 60.4 |
| D-25 | $a_1$ | 5.07 | 4.05 | 29.0 | 11.19 | 1.30 | 1.26 | 3.29 | 0.89 | 1.04 | 52.1 |
| D-25 | $a_3$ | 1.79 | 1.31 | 28.8 | 11.33 | 1.45 | 1.28 | 2.90 | 0.86 | 1.07 | 52.3 |

*Total residue less carbides, Table III increases to about 4% after the high temperature treatment. Typical transmission micrographs are set forth in FIGS. 8–17.

Figure 8:
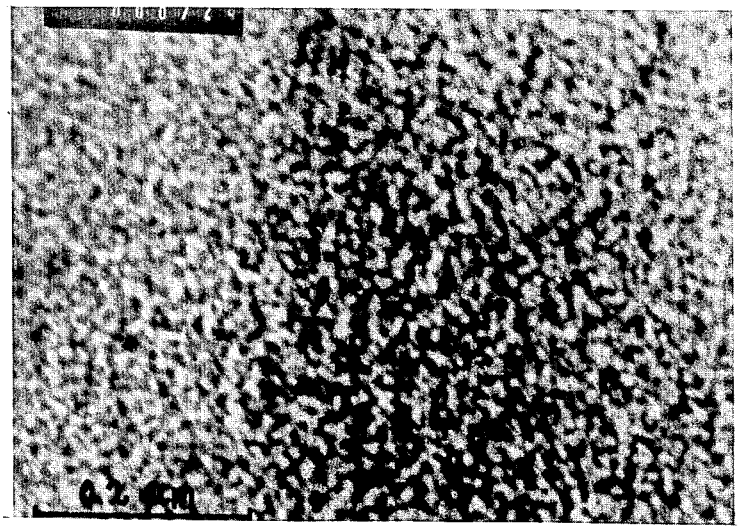
FIG. 8 is a transmission photomicrograph of Alloy D-21B detailing the $\gamma'$ precipitate.
Figure 9:
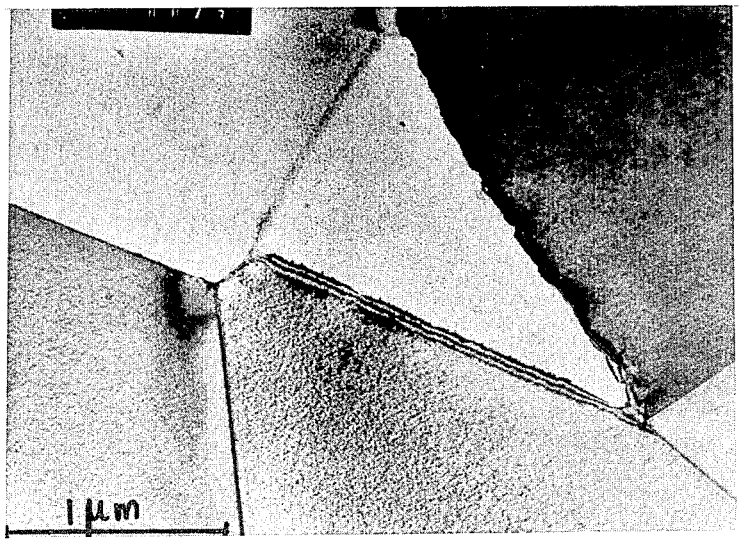
FIG. 9 is a transmission photomicrograph of the grain boundaries of Alloy D-21A.
Figure 10:
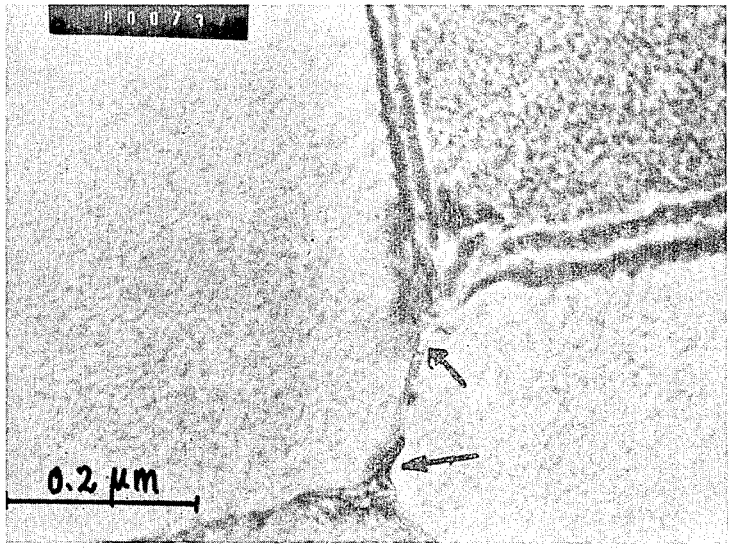
FIG. 10 is a transmission photomicrograph of Alloy D-25A illustrating the initial stages of grain boundary precipitation.
Figure 11:
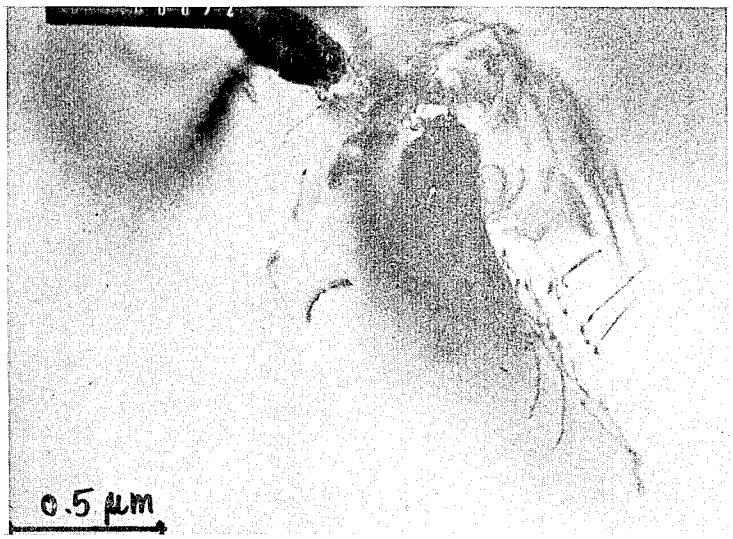
FIG. 11 is a transmission photomicrograph of Alloy D-25A showing carbide within the grain.
Figure 12:
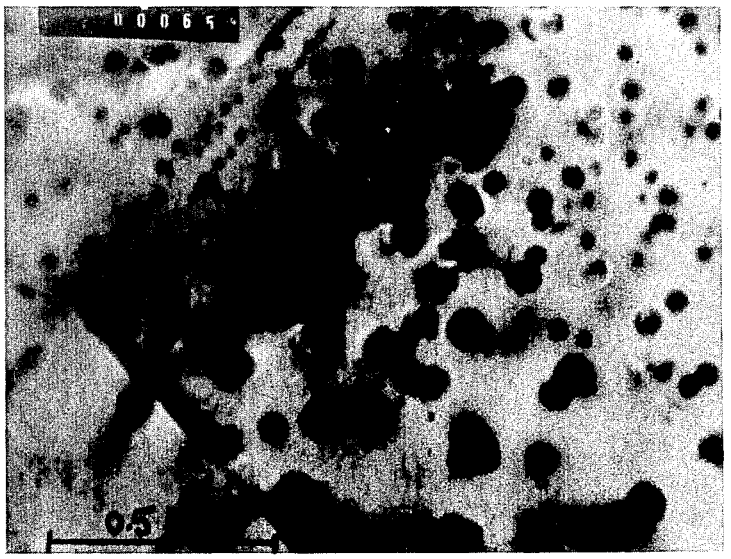
FIG. 12 is a transmission photomicrograph of Alloy D-21B with the $\gamma'$ Bright Field.

It should be noted that gamma-prime was barely resolvable following the low temperature heat treatment as shown in FIG. 8 for alloy D-25A. This was typical of all three of the modified alloys. The grain boundary structures are shown in FIGS. 9 and 10. These micrographs are typical of the low temperature aging and depict virtually precipitation-free boundaries. The arrows in FIG. 10 point to the initial stages of grain boundary precipitation. Carbide particles such as shown in FIG. 11 were found within the grains and showed the expected dislocation networks. These could have originated during rolling or heat treatment or both and represent stress relaxation at the carbide-matrix interface.

Figure 13:
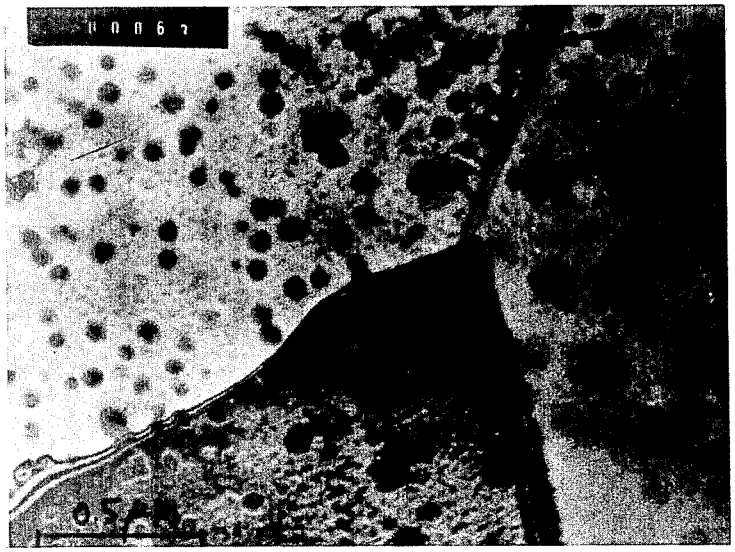
FIG. 13 is a transmission photomicrograph of Alloy D-25A illustrating occasional precipitation in the grain boundaries.
Figure 14:
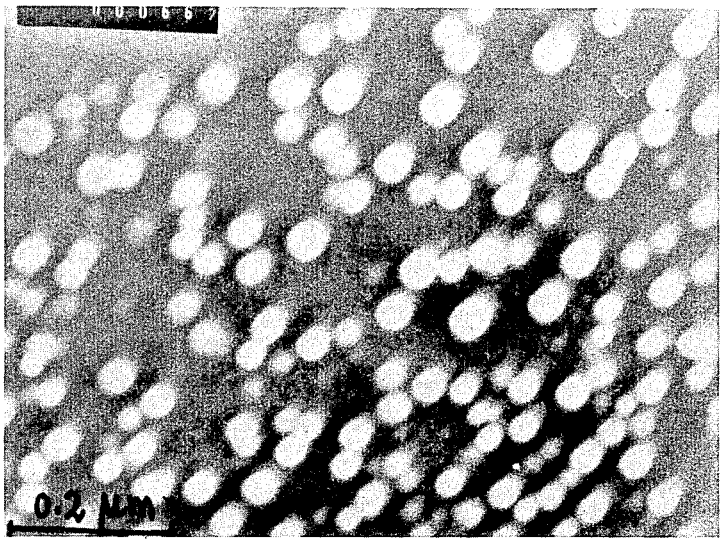
FIG. 14 is a transmission photomicrograph of Alloy D-21A with the Dark Field $\gamma'$.
Figure 15:
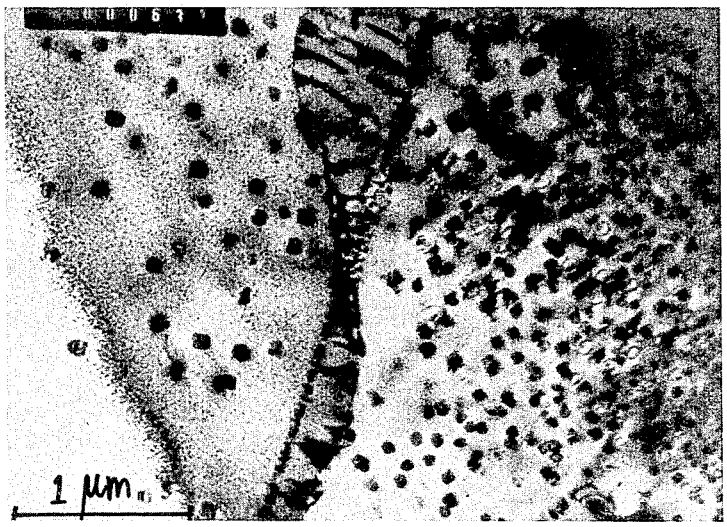
FIG. 15 is a transmission photomicrograph of Alloy D-21A showing cellular growth of $\gamma'$.
Figure 16:
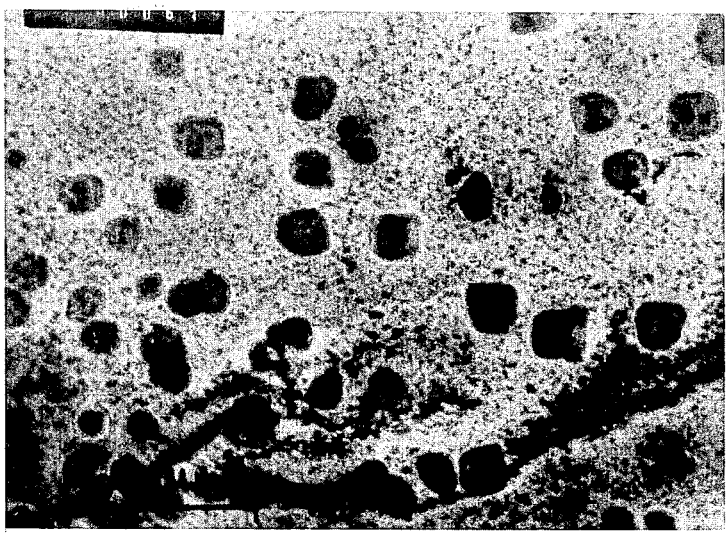
FIG. 16 is a transmission photomicrograph of Alloy D-21A illustrating occasionally absessed large $\gamma'$ particles.

The aging treatment for 10 hours at 815° C. produced well-defined gamma-prime and occasionally discrete particles in the grain boundaries. Typical gamma-prime morphologies are shown in FIGS. 12–17. The low molybdenum, D-21A and D-21B, exhibited strain fields around the gamma-prime particles indicating a high mismatch. The mismatch strains were brely visible in the high molybdenum alloy, namely, D-25A, as shown in FIG. 13. The dark field micrographs were used to measure the gamma-prime size distribution and a typical structure is shown in FIG. 14. The gamma-prime size distribution for these alloys all showed a bimodel distribution with the average gamma prime particle diameter within the range between about 250 and 280 angstrom units. A few areas of non-typical gamma-prime morophologies were seen in various foils examined by transmission microscopy. Examples are shown in FIGS. 15 and 16. The cellular growth of gamma prime is shown in FIG. 16 and the cuboidal shape of the gamma-prime particles is shown in FIGS. 15 and 16. This change in particle shape indicates a change in the coherency strain of the matrix-particle interface and is probably associated with overaging as is demonstrated by the size of the particles, namely over about 1000 angstrom units.

Figure 17:
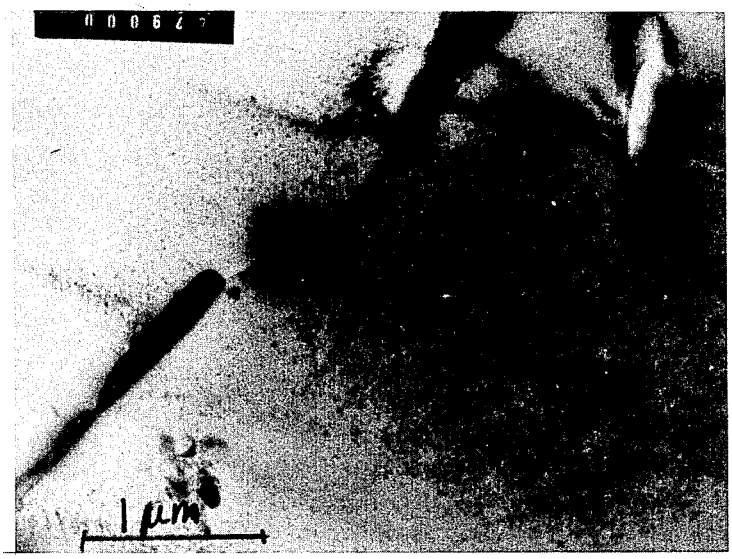
FIG. 17 is a transmission photomicrograph of Alloy D-25A showing occasional discrete precipitates in grain boundaries.

MC carbide precipitation was confined mainly to the gain interior FIGS. 5A through 7B inclusive and FIG. 11. The other phases, Laves and borides, tended to precipitate in the grain boundaries. The low volume fraction of these phases even after the 815° C. aging (Table IV) resulted in occasional discrete precipitates in the boundaries, as illustrated in FIG. 17. Note that FIGS. 9 and 10 are typical of the extent of grain boundary precipitation and FIG. 17 represents a non-typical region.

From the foregoing analysis of the thermal phase stability, it may be concluded that the reduction in the amount of silicon leads to a substantial reduction in the grain boundary precipitation in the developmental alloys D-21 and D-25. The volume fraction of the metal carbides is determined mainly by the amounts of titanium present within the composition. The reduction in the total amount of residue in the carbide extraction represents therefore a major decrease in the volume fraction of laves and other phases. The atomic absorption analysis were in agreement with the weight percentage analysis of the gamma-prime measured from the residues. Thus the gamma-prime precipitate did not reach equilibrium at 700° C. after 24 hours or after 10 hours at 815° C. Consequently, the volume fraction and general distribution of gamma prime is the same for the modified alloys, namely, the low silicon alloys, as for the original D21 and D25 compositions.

Figure 18:
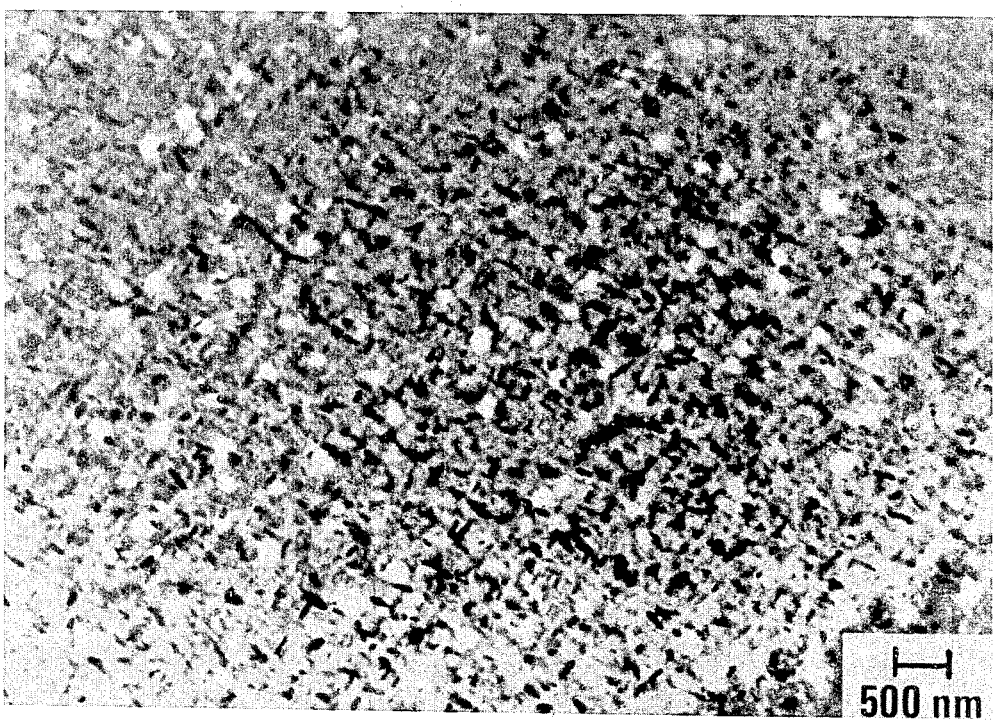
FIG. 18 is an electron micrograph of Alloy D-21 in the $A_3$ condition after nickel-ion irradiation to 220 dpa at 550° C.
Figure 19:
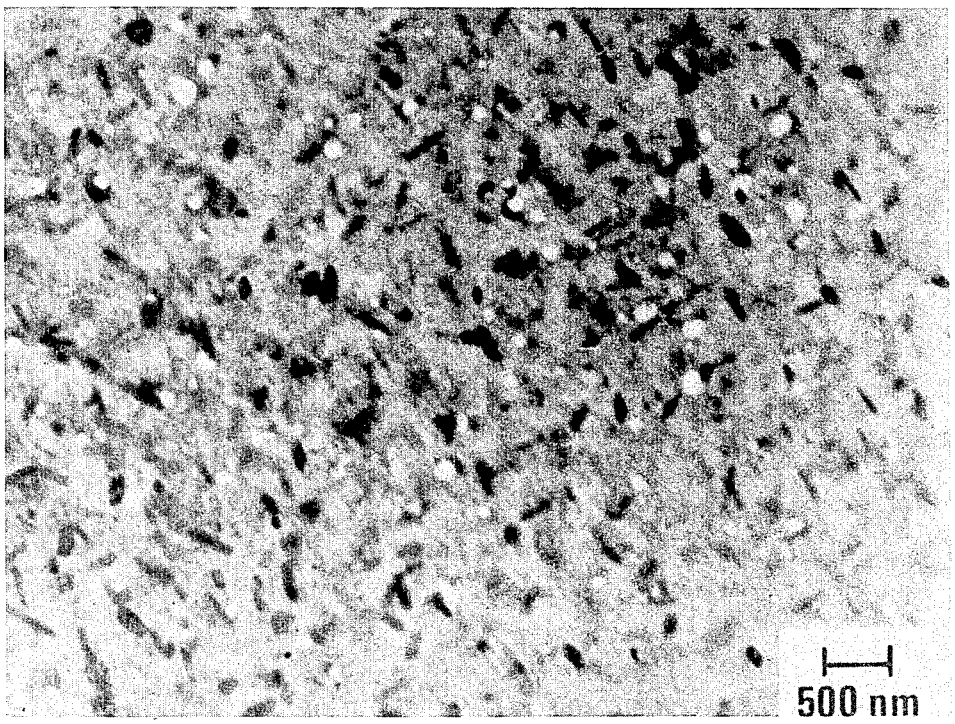
FIG. 19 is an electron micrograph of Alloy D-25 in the $A_3$ condition after nickel-ion irradiation to 220 dpa at 550° C.

Referring to FIGS. 18 and 19, it can be seen that both Alloys D-21 and D-25 are essentially free of voids (less than 0.2% of the volume) as a result of being subjected to the radiation with Ni-ions as set forth hereinbefore. In addition, there appears to be no apparent swelling exhibited by these alloys as a result of irradiation thus making these alloys suitable for their intended use.

In view thereof, the alloy of the present invention is eminently suited for use as a fuel cladding and duct material in a liquid metal fast breeder reactor for which the present composition of matter has been designed.

We claim:

1. A precipitation hardenable alloy suitable for use at elevated temperatures and especially in a liquid metal fast breeder reactor consisting essentially of up to about 0.06% carbon, up to 2% manganese, up to about 1% silicon, up to 0.1% zirconium, up to 0.06% vanadium, from about 23% to about 31% nickel, from about 8% to about 11% chromium, from about 1.7% to about 3.5% titanium, from about 1% to about 1.8% aluminum, from about 0.09% to about 3.7% molybdenum, from about 0.004% to about 0.008% boron and the balance iron with incidental impurities, the alloy exhibiting a swelling at peak swelling temperature of less than 10% wherein the matrix composition after heat treatment at 1050° C. for about ½ hour following aging at 700° C. for 24 hours at 815° C. for 10 hours and in which the matrix composition after removing the non-equilibrium gamma-prime and other precipitated phases has a composition within the range between about 23% and about 29% nickel, about 7% and about 11.5% chromium, about 1.3% and about 2.6% titanium, about 1.2% and about 1.5% aluminum, and about 0.9% and about 3.3% molybdenum.

2. An iron base austenitic gamma-pride hardened alloy containing chromium and nickel and which is suitable for use in a liquid metal fast breeder reactor, the matrix of said alloy after heat treatment for about ½ hour at a temperature of 1050° C. followed by aging at a temperature of between about 700° C. and 815° C. for a time period of about 10 hours to about 24 hours, the longer times being associated with the lower temperatures and vice versa having a composition consisting of from about 23% to about 29% nickel, from about 7% to about 11.5% chromium, from about 1.3% to about 2.6% titanium, from about 1.2% to about 1.5% aluminum, from about 0.9% to about 3.3% molybdenum and the balance essentially iron, the alloy being characterized by exhibiting low swelling resulting from irradiation, said swelling not exceeding about 7% at the peak swelling temperature.

3. The alloy of claim 1 having a controlled swelling resulting from the influence of irradiation and suitable for use at elevated temperatures consisting essentially of from about 0.04% to about 0.06% carbon, up to 1.0% manganese, from 0.05% to about 1.0% silicon, from about 0.005% to about 0.05% zirconium, up to 0.5% vanadium, from about 24.5% to about 25.5% nickel, from about 8.25% to about 8.75% chromium, from about 3.0% to about 3.5% titanium, from about 1.5% to about 1.8% aluminum, from about 0.9% to about 1.25% molybdenum, from about 0.0045% to about 0.0055% boron, and the balance essentially iron wherein the matrix composition after heat treatment at a temperature within the range between 1000° C. and 1100° C. for about one-half hour following aging at a temperature within the range between 700° C. and about 815° C. for a time period of between about 10 and about 24 hours, the longer hours being associated with the lower temperatures and vice versa, said matrix composition after the removal of the non-equalibrium gamma-prime and other precipitated phases has a composition within the range between about 23% and about 29% nickel, about 7% and about 11.5% chromium, about 1.3% and about 2.6% titanium, about 1.2% and about 1.5% aluminum and about 0.9% and about 3% molybdenum. The balance being essentially iron.

4. An iron base austenitic gamma-prime hardened alloy having a gross stoichiometry of between about 0.04% and about 0.06% carbon, up to 1% manganese, from 0.05% to 1.0% silicon, up to about 0.1% zirconium, from about 29.5% to about 30.5% nickel, from about 10.25% to about 10.75% chromium, from about 1.7% to about 2.1% titanium, from about 1.5% to about 1.8% aluminum, from about 3.5% to about 3.7% molybdenum, from about 0.006% to about 0.007% boron and the balance essentially iron, said alloy having a matrix after heat treatment at a temperature within the range between about 1000° C. and about 1100° C. for a time period of up to about one hour followed by aging between about 700° C. and 815° C. for a time period of about 10 hours to about 24 hours, the longer time being associated with the lower temperatures, and vice versa, said matrix having a composition consisting of about 23% to about 29% nickel, from about 7% to about 11.5% chromium, from about 1.3% to about 2.6% titanium, from about 1.2% to about 1.5% aluminum, from about 0.9% to about 3.3% molybdenum, and the balance essentially iron.

* * * * *